United States Patent [19]

Arabori et al.

[11] Patent Number: 4,870,254

[45] Date of Patent: Sep. 26, 1989

[54] HOT AIR CIRCULATING COOKER

[75] Inventors: Yoshinari Arabori; Shigekazu Sumida, both of Nagoya, Japan

[73] Assignee: Kabushiki Kaisha Toshiba, Kawasaki, Japan

[21] Appl. No.: 235,768

[22] Filed: Aug. 23, 1988

Related U.S. Application Data

[63] Continuation of Ser. No. 26,996, Mar. 17, 1987, abandoned.

[30] Foreign Application Priority Data

May 15, 1986 [JP] Japan ..... 61-111110
Jun. 24, 1986 [JP] Japan ..... 61-147540

[51] Int. Cl.[4] ..... F27D 7/04
[52] U.S. Cl. ..... 219/400; 126/21 A
[58] Field of Search ..... 219/400, 385, 386, 521; 126/21 A, 21 R; 34/195, 197, 210, 215, 218, 219, 224, 225, 231, 232, 233

[56] References Cited

U.S. PATENT DOCUMENTS

| | | | |
|---|---|---|---|
| 2,582,887 | 1/1952 | Sanford | 126/21 A |
| 2,906,620 | 9/1959 | Jung | 126/21 A |
| 3,081,392 | 3/1963 | Warner | 126/21 A |
| 3,324,844 | 6/1967 | Huffman | 126/21 A |
| 3,984,578 | 10/1976 | Rohrl | 126/21 A |
| 4,415,799 | 11/1983 | Tanaka | 219/400 |
| 4,641,015 | 2/1987 | Mayeur | 219/386 |

FOREIGN PATENT DOCUMENTS

| | | | |
|---|---|---|---|
| 2307914 | 9/1974 | Fed. Rep. of Germany | 126/21 A |
| 2339446 | 2/1975 | Fed. Rep. of Germany | 126/21 A |
| 2557867 | 6/1977 | Fed. Rep. of Germany . | |
| 2657267 | 6/1978 | Fed. Rep. of Germany . | |
| 53-136572 | 5/1977 | Japan | 219/400 |
| 58-106331 | 6/1983 | Japan | 219/400 |
| 2109920 | 6/1983 | United Kingdom | 126/21 A |

*Primary Examiner*—Teresa J. Walberg
*Attorney, Agent, or Firm*—Cushman, Darby & Cushman

[57] ABSTRACT

A hot air circulating cooker includes a box-like casing defining a heating chamber. A rear plate of the casing has suction holes at its center portion and upper and lower discharge holes located above and below the suction holes. A cover is fixed to the outer surface of the rear plate to define a storing chamber. A fan is arranged in the storing chamber to face the suction holes. When being rotated in a predetermined direction, the fan draws air in the heating chamber into the storing chamber through the suction holes, flows the drawn air in the predetermined direction, and discharges the air to the heating chamber through the discharge holes. An upper airflow-directing mechanism is provided in the storing chamber so as to guide part of the air flow to those of the upper discharge hole which are located at an upstream side of the air flow in the storing chamber. A lower airflow-directing mechanism is provided in the storing chamber so as to guide part of the air flow to those of the lower discharge holes which are located at an upstream side of the air flow in the storing chamber.

13 Claims, 5 Drawing Sheets

HOT AIR CIRCULATING COOKER

This is a continuation of application Ser. No. 026,996, filed Mar. 17, 1987, which was abandoned upon the filing hereof.

BACKGROUND OF THE INVENTION

The present invention relates to a hot air circulating cooker for heating and cooking food in a heating chamber by supplying hot air to the heating chamber using a fan.

Generally, a hot air circulating cooker has an inner casing defining a heating chamber and a disk-like cover attached on the outer surface of the rear wall of the inner casing. The cover and the rear wall define a fan chamber. A hot air circulating fan and a heater are provided in the fan chamber. A plurality of suction holes are cut by punching in the central portion of the rear wall. Upper discharge holes are cut by punching in a rectangular area of the upper portion of the rear wall, and lower discharge holes are cut in a rectangular area of the lower portion of the rear wall. Bath rectangular area extend in the horizontal direction. The fan opposes the suction holes and is driven by a motor provided outside the cover. The heater has an annular shape and is provided around the fan.

When the fan and heater are operated, the air in the heating chamber is drawn into the fan chamber through the suction holes and is heated by the heater. The hot air is blown into the heating chamber through the discharge holes. As a result, the hot air is circulated in the heating chamber to heat and cook food in the heating chamber.

In the cooker having the above arrangement, the fan is rotated in a one predetermined direction. The hot air in the fan chamber also flows in the same direction. Thus, the hot air discharged from the discharge holes is unpreferably biased in the rotating direction of the fan. For example, where the upper discharge holes are concerned, the amount of hot air discharged from the holes located at the downstream side of the hot air flow is larger than that discharged from the holes located at the upstream-side. This imbalance in the hot air discharge amount at different portions of the discharge holes causes the food in the heating chamber to be nonuniformly cooked.

In another type of known cooker, a rotating tray is provided in a heating chamber and food is cooked while being rotated by the rotating tray. According to this cooker, nonuniform cooking of food can be decreased to a certain degree. However, in a cooker having a stationary cooking tray, e.g., a cooker having two cooking trays in its heating chamber so as to cook a large amount of food at once, nonuniform cooking can easily occur due to the imbalance in hot air discharge amount.

SUMMARY OF THE INVENTION

The present invention has been made in view of the above situation and has as its object to provide a hot air circulating cooker which can uniformly discharge hot air from its discharge holes, thereby decreasing nonuniform heating of food.

In order to achieve the above object, a cooker according to the present invention comprises: a box-like casing having top and bottom plates and a plurality of side plates and defining a heating chamber for storing food therein, one of the side plates having a plurality of suction holes formed in a central portion thereof, a plurality of upper discharge holes formed in an area which is located above the suction holes and extends along a horizontal direction, and a plurality of lower discharge holes formed in an area which is located under the suction holes and extends in the horizontal direction; a cover fixed to an outer surface of said one side plate, for defining, associated with said one side plate, a storing chamber communicating with the suction holes and the upper and lower discharge holes; a fan arranged in the storing chamber to oppose the suction holes and rotated in a predetermined direction, for drawing air in the heating chamber to the storing chamber through the suction holes, flowing the air in the predetermined direction in the storing chamber, and discharging the air to the heating chamber through the discharge holes; a heater arranged in the storing chamber and located to surround the fan, for heating air drawn into the heating chamber; drive means for rotating the fan; upper airflow-directing means provided in the storing chamber, for guiding part of an airflow formed by the fan to those of the upper discharge holes which are located at an upstream side of the air flow in the storing chamber; and lower airflow-directing means provided in the storing chamber, for guiding part of the airflow formed by the fan to those of the lower discharge holes which is located at an upstream side of the air flow in the storing chamber.

BRIEF DESCRIPTION OF THE DRAWINGS

FIGS. 1 to 4 show a hot air circulating cooker according to a first embodiment of the present invention, in which FIG. 1 is a longitudinal sectional view of the cooker, FIG. 2 is a sectional view taken along the line II—II of FIG. 1, FIG. 3 is a front view of the same including a fan and a heater, and FIG. 4 is a partial enlarged view of FIG. 3;

FIGS. 9 and 10 show a fifth modification of the airflow-directing plate, in which FIG. 9 is a front view corresponding to FIG. 3 and FIG. 10 is a sectional view of a part of a cooker including an airflow-directing plate.

DETAILED DESCRIPTION OF THE PREFERRED EMBODIMENTS

The embodiments of the present invention will be described in detail with reference to the accompanying drawings.

Figure 1:
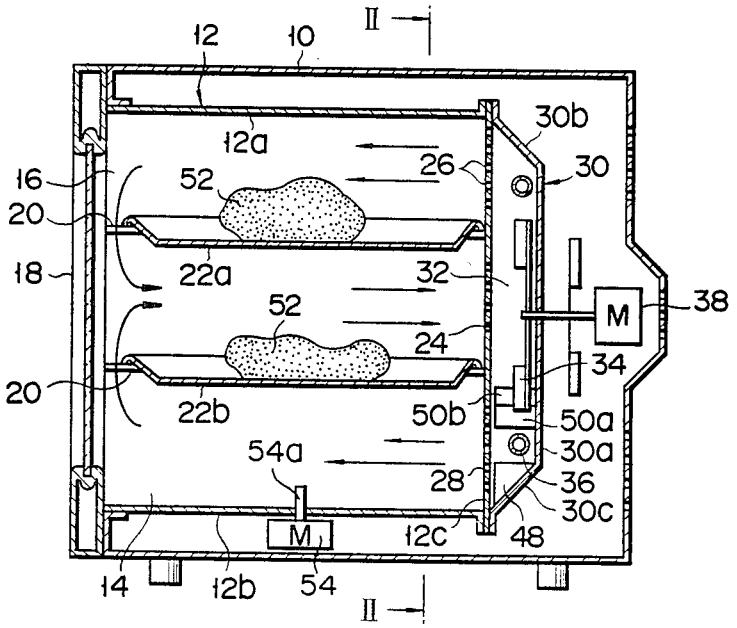
Figure 2:
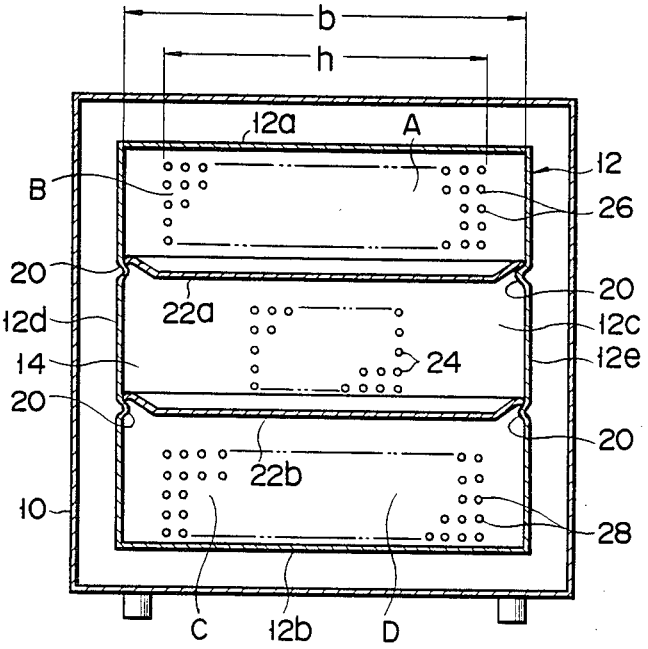
Figure 3:
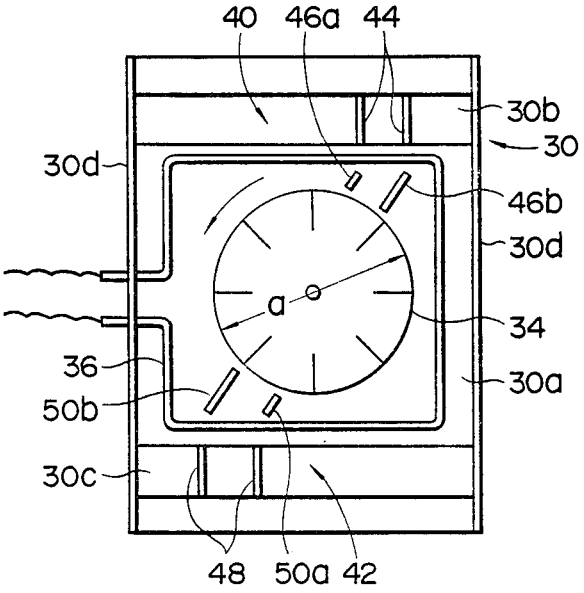

As shown in FIGS. 1 to 3, a cooker has outer casing 10 and inner casing 12 which is provided in casing 10 and defines heating chamber 14. Casing 12 is a box having top and bottom plates 12*a* and 12*b* and three side plates 12*c* to 12*e*. The front portion of casing 12 is opened to constitute inlet/outlet port 16 for allowing food to be placed in and removed from heating chamber 14 therethrough. Port 16 is opened/closed by door 18 attached to casing 10.

A pair of horizontal support rails 20 are formed on the inner surface of each of side walls 12*d* and 12*e*. Upper and lower cooking trays 22*a* and 22*b* are arranged in heating chamber 14 while their side edges are put on rails 20. Rails 20 are positioned such that the distances between top plate 12*a* of casing 12 and tray 22*a*, between trays 22*a* and 22*b*, and between tray 22*b* and bottom plate 12*b* are substantially the same.

A plurality of suction holes 24 are cut by punching in the central portion of side plate 12*c* constituting the rear plate of casing 12 and are distributed in a rectangular form. Holes 24 are located between cooking trays 22*a* and 22*b*. A plurality of upper and lower discharge holes 26 and 28 are formed in rear plate 12*c* and located above and below suction holes 24, respectively. Upper discharge holes 26 are arranged in a rectangular area which extends throughout substantially the entire width of plate 12*c* and are located between top plate 12*a* and upper cooking tray 22*a*. Lower discharge holes 28 are arranged in a rectangular area which extends throughout substantially the entire width of plate 12*c* and are located between bottom plate 12*b* and lower cooking tray 22*b*.

Rectangular disk-like cover 30 is fixed to the outer surface of rear plate 12*c*. Cover 30 and plate 12*c* define storing chamber 32. Chamber 32 communicates with heating chamber 14 through suction holes 24 and discharge holes 26 and 28. As is apparent from FIGS. 1 and 3, cover 30 has bottom plate 30*a* opposing rear plate 12*c*, upper and lower inclined plates 30*b* and 30*c* extending in the horizontal direction, and a pair of side plates 30*d* extending in the vertical direction. Plates 30*b* and 30*c* oppose upper and lower discharge holes 26 and 28, respectively. In chamber 32, fan 34 is arranged so as to face suction holes 24, and substantially annular electric heater 36 is provided to surround fan 34. Fan 34 is rotated by motor 38, provided outside cover 30, in a predetermined direction, i.e., counterclockwise in FIG. 3.

As indicated by arrows in FIG. 1, when fan 34 is rotated, air in heating chamber 14 is drawn from suction holes 24 into storing chamber 32. After being heated by heater 36, the air is guided by upper and lower plates 30*b* and 30*c* and discharged from upper and lower discharge holes 26 and 28 into heating chamber 14.

With the above arrangement, the hot air in storing chamber 32 flows counterclockwise to make a whirl. Thus, the hot air to be blown from holes 26 and 28 is biased to the upstream side of the hot air flow. More specifically, as shown in FIG. 2, the amount of hot air discharged from some holes 26 in region B located at the downstream side of the hot air flow in storing chamber 32 is larger than that discharged from some other holes 26 in region A at the upstream side of the hot air flow. Similarly, the amount of hot air discharged from some holes 28 in region D located at the downstream side of the hot air flow in storing chamber 32 is larger than that discharged from some other holes 28 in region C at the upstream side. Therefore, in order to prevent the unbalance of the amount in discharged hot air, according to this embodiment, upper and lower airflow-directing mechanisms 40 and 42 are provided in chamber 32 so as to face regions A and C, respectively.

Figure 4:
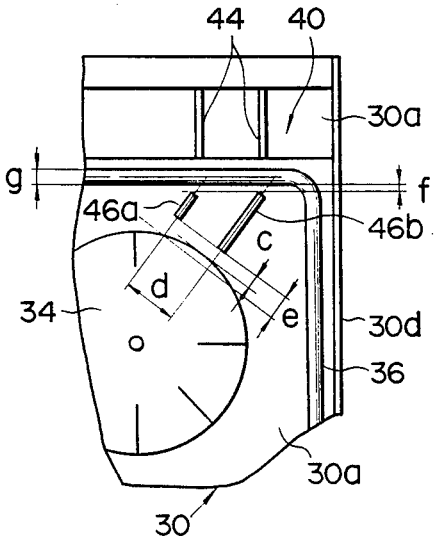

As shown in FIGS. 3 and 4, upper airflow-directing mechanism 40 has a pair of first airflow-directing plates 44 and a pair of second airflow-directing plates 46*a* and 46*b*. First plates 44 have a triangular shape, are fixed to upper plate 30*b* of cover 30, and extend in the vertical direction. Second plates 46*a* and 46*b* are perpendicularly fixed to bottom plate 30*a* of cover 30 and located between the outer periphery of fan 34 and heater 36. Plates 46*a* and 46*b* have a rectangular shape. Plate 46*a* is shorter than plate 46*b*. Plates 46*a* and 46*b* are arranged parallel to each other and extend from the regions close to the lower ends of first airflow-directing plates 44 toward the rotational center of fan 34.

Similarly, lower airflow-directing mechanism 42 has a pair of first airflow-directing plates 48 and a pair of second airflow-directing plates 50and 50*b*. First plates 48 and second plates 50*a* and 50*b* are point-symmetrical to first plates 44 and second plates 46*a* and 46*b*, respectively, with respect to the rotational center of fan 34. In other words, first plates 48 are fixed to lower plate 30*c* of cover 30 and extend in the vertical direction, and second plate 50*a* and 50*b* are fixed to bottom plate 30*a* of cover 30 and located between the outer periphery of fan 34 and heater 36.

The sizes of the respective portions of first and second airflow-directing mechanisms 40 and 42 are set as follows so as to provide a good airflow-directing effect.

As shown in FIGS. 2 to 4, diameter a of fan 34 is set in a range of about $\frac{1}{2}$ to $\frac{1}{3}$ width b of heating chamber 14. In other words, assuming that width b is 300 mm, diameter a of fan 34 is 130 mm. In upper airflow-directing mechanism 40, distance c between second airflow-directing plate 46*b* and the outer periphery of fan 34 is set to be about 1/10 to 1/20 diameter a of fan 34 and is, in this embodiment, 9 mm. Distance e between second airflow-directing plate 46*a* and the outer periphery of fan 34 is set to be about 1/5 to 1/10 diameter a of fan 34 and is, in this embodiment, 19 mm. Distance d between plates 46*a* and 46*b* is set in a range of about $\frac{1}{3}$ to 1/6 diameter a of fan 34 and is, in this embodiment, 33 mm. Distance between first airflow-directing plates 44 corresponds to distance d.

Distance f between second airflow-directing plates 46*a* and 46*b*, and heater 36 is set in a range of about $\frac{1}{2}$ to 1/10 diameter g of heater 36. A general heater has diameter g of about 7 mm and hence distance f is set to 1 mm. Width h of the regions, wherein upper and lower discharge holes 26 and 28 are formed, is set to $\frac{2}{3}$ or more of width b of heating chamber 14 ($h > 200$ mm). Holes 26 and 28 are uniformly distributed in the right and left portions of heating chamber 14 so that the hot air uniformly reaches the entire area of heating chamber 14.

The airflow-directing plates of lower airflow-directing mechanism 42 have sizes similar to those of upper airflow-directing mechanism 40 and a description thereof is omitted.

In FIG. 1, reference numeral 54 denotes a motor. Rotation shaft 54*a* of motor 54 extends into heating chamber 14 through bottom plate 12*b* of casing 12. With cooking trays 22*a* and 22*b* not in use, a turntable (not shown) is placed in engagement with rotation shaft 54*a* within heating chamber 14 such that it may be rotated by motor 54. The cooker is also further provided with a magnetron (not shown) and can be used as a microwave oven.

The operation of the cooker having the above arrangement will be described.

When a large amount of food is heated and cooked simultaneously, upper and lower cooking trays 22*a* and 22*b* placing food 52 thereon are set in heating chamber 14 through inlet/outlet port 16. After door 18 is closed, an operating section (not shown) is operated to energize motor 38 and heater 36. When fan 34 is rotated counterclockwise by motor 38, the air between trays 22*a* and 22*b* in chamber 14 is drawn into storing chamber 32 through suction holes 24. The sucked air flows to the periphery of fan 34, and makes a counter-clockwise whirl around fan 34. At the same time, the air is heated by heater 36.

The hot air abuts against upper and lower plates 30*b* and 30*c* of cover 30 and directed toward rear plate 12*c* of inner casing 12. Thus, the hot air is discharged from discharge holes 26 and 28 into heating chamber 14. The hot air from holes 26 is blown into a space between top plate 12*a* of casing 12 and upper cooking tray 22*a*, and the hot air from holes 28 is blown into a space between bottom plate 12*b* of casing 12 and lower cooking tray 22*b*.

In the upper region of storing chamber 32, part of the hot air is prevented by airflow-directing plates 44, 46*a* and 46*b* of upper airflow-directing mechanism 40 from flowing along the rotating direction of fan 34 and guided to a region opposing upstream-side region A of discharge holes 26. The hot air is then directed toward rear plate 12*c* by upper plate 30*b* of cover 30 and discharged to heating chamber 14 through discharge holes 26 at upstream-side region A. The remaining hot air is discharged from holes 26 located at downstream-side region B.

Similarly, in the lower region of storing chamber 32, part of the hot air is prevented by lower airflow-directing mechanism 42 from flowing along the rotating direction of fan 34 and discharged to heating chamber 14 through discharge holes 28 located at upstream-side region C. The remaining hot air is discharged from holes 28 located at downstream-side region D. As a result, the hot air is not biased in a single direction but is uniformly discharged from holes 26 and 28 of the respective regions.

As described above, according to the hot air circulating cooker having the above arrangement, the amount of hot air discharged from discharge holes 26 and 28 located at upstream-side regions A and C is increased because of the straightening function of upper and lower airflow-directing mechanisms 40 and 42, and becomes equal to that discharged from holes 26 and 28 located at downstream-side regions B and D. As a result, imbalance in amount of discharged hot air between the holes in the upstream- and downstream-side regions is eliminated, and hot air can be uniformly supplied to the entire portion in the heating chamber. Thus, a hot air does not locally blow against part of food in the heating chamber, and nonuniform heating and cooking caused by the nonuniform hot air amount can be prevented. According to this embodiment, in addition to the first airflow-directing plates, each airflow-directing mechanism has the second airflow-directing plates that extend to the regions close to the outer periphery of fan 34. Therefor, the hot air can be guided to the discharge holes located in the upstream-side region immediately after fan rotation is started.

The sizes of the respective portions were examined in an experiment, and most effective, uniform supply of hot air was obtained when sizes a to g were set in the ranges described above. When the sizes of the respective portions are out of the above described ranges, the following problems arose.

For example, when diameter a of fan 34 exceeded $\frac{1}{2}$ width b of heating chamber 14, the distance between the outer periphery of fan 34 and heater 36 was decreased, and the straightening effect by upper and lower airflow-directing mechanisms 40 and 42 was excessive, resulting in nonuniform heating. In accordance with increase of diameter a, the discharge amount of hot air was decreased. Conversely, when diameter a was set to be less than $\frac{1}{3}$ width b, the blow amount by fan 34 was decreased, and the supply of hot air to heating chamber 14 was delayed.

When distance c between the second airflow-directing plate and the outer periphery of fan 34 exceeded 1/10 diameter a of fan 34, the straightening effect by the airflow-directing mechanism was degraded, and the cooked color of the food placed on the left portion of upper cooking tray 22*a* in FIG. 2 was darker. Conversely, when distance c was less than 1/20 diameter a, the cooked color of the food placed on the left front portion of tray 22*a* was extremely pale. A change in distance e caused effects similar to that in distance c described above.

When distance d between the second airflow-directing plates exceeded $\frac{1}{3}$ diameter a of fan 34, the straightening effect by the airflow-directing mechanism was excessive, and nonuniform heating occurred. When distance d was less than 1/6 diameter a, the hot air blowing state was the same as in the case wherein no airflow-directing mechanism was provided.

When distance f between the second airflow-directing plate and heater 36 exceeds $\frac{1}{2}$ diameter g of heater 36, hot air leaks from a gap between the airflow-directing plates and heater 36, and the blow amount of air straightened by the airflow-directing mechanism is decreased. As a result, nonuniform heating occurs. When distance f is less than 1/10 diameter g, the second airflow-directing plates may unpreferably contact heater 36 by vibration during operation of the cooker or impact when the cooker is being moved.

When the sizes of the respective portions are set properly as in the above embodiment, the above-mentioned problem can be solved, and hot air can be blown into the heating chamber with good balance.

The present invention is not limited to the above embodiment but various changes and modifications may be made within the spirit and scope of the invention.

Figure 5:
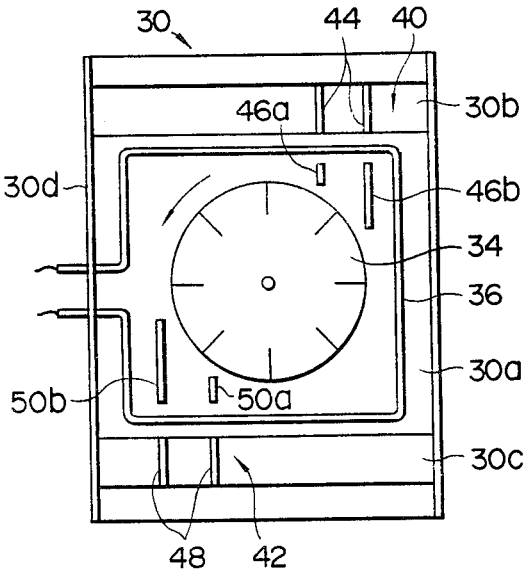
FIGS. 5 to 8 are front views corresponding to FIG. 3 and showing first to fourth modifications of an airflow-directing plate, respectively.

For example, in the embodiment, each airflow-directing mechanism has a pair of second airflow-directing plates. However, the inner one, i.e., the smaller one of the second airflow-directing plates can be omitted. Second airflow-directing plates 46*a* and 46*b*, or 50*a* and 50*b* can be arranged in the vertical direction as shown in FIG. 5. In this case, the dimensional relationship among the width of heating chamber 14, the diameter of fan 34, the distance between fan 34 and the airflow-directing plates, and the distance between the second airflow-directing plates and heater 36; and the sizes and mounting positions of the first and second airflow-directing plates are set so as to obtain hot air blowing characteristics to effectively decrease nonuniform heating.

Figure 6:
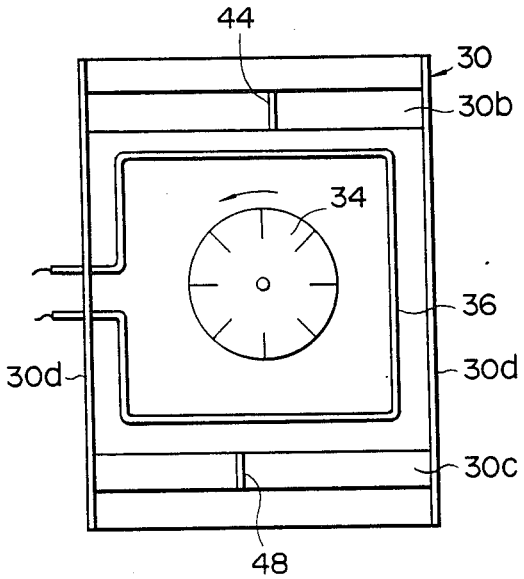
Figure 7:
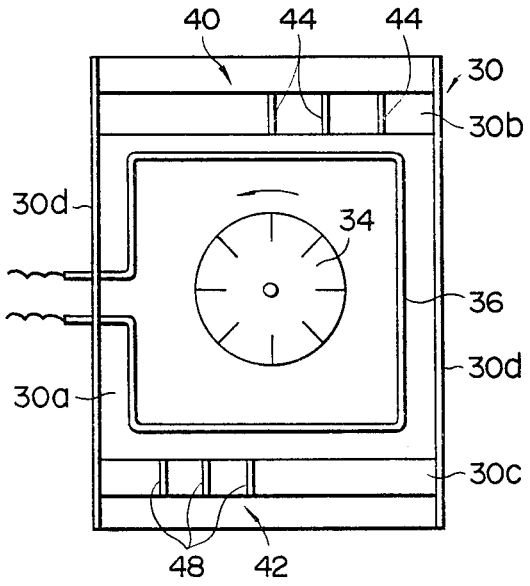

As shown in FIGS. 6 and 7, each airflow-directing mechanism can be constructed by only first airflow-directing plates. The number of the first airflow-directing plates is increased/decreased as needed, and the sizes and mounting positions thereof are properly set. However, first airflow-directing plate 44 of upper airflow-directing mechanism 40 and airflow-directing plate 48 of lower airflow-directing mechanism 42 are point-symmetrically arranged with respect to the rotational center of fan 34, irrespective of the number of the first airflow-directing plates. When the number of the airflow-directing plates is increased, the hot air blow amount can be finely adjusted.

Figure 8:
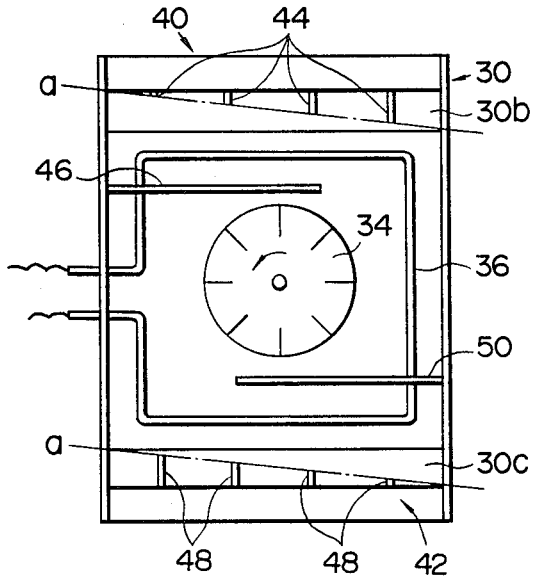

In the modification shown in FIG. 8, upper airflow-directing mechanism 40 has a plurality of first airflow-directing plates fixed to upper plate 30*b* of cover 30. These plates 44 are separated from each other at the same intervals along the horizontal direction and extend in the vertical direction. The lengths of respective airflow-directing plates 44 are set such that a line connecting the lower ends of plates 44 coincides with diagonal line a of plate 30*b*. This increases straightening effect in a region at the upstream-side of the hot air flow. Airflow-directing mechanism 40 has second airflow-directing plate 46 located in the upper region of storing chamber 32. Plate 46 extends substantially horizontally from side plate 30*d* of cover 30, located at the downstream side of the hot air flow, to the substantially central portion of storing chamber 32. Plate 46 is positioned between fan 34 and heater 36. Similarly, lower airflow-directing mechanism 42 has a plurality of first airflow-directing plates 48 and second airflow-directing plate 50 and is point-symmetrical with mechanism 40 with respect to the rotational center of fan 34.

Figure 9:
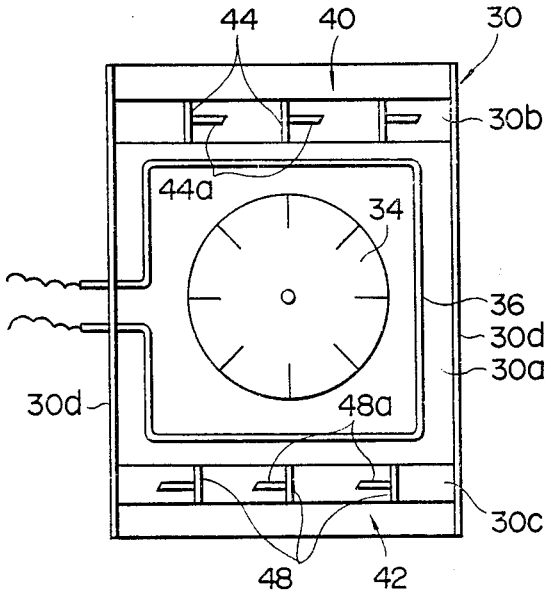
Figure 10:
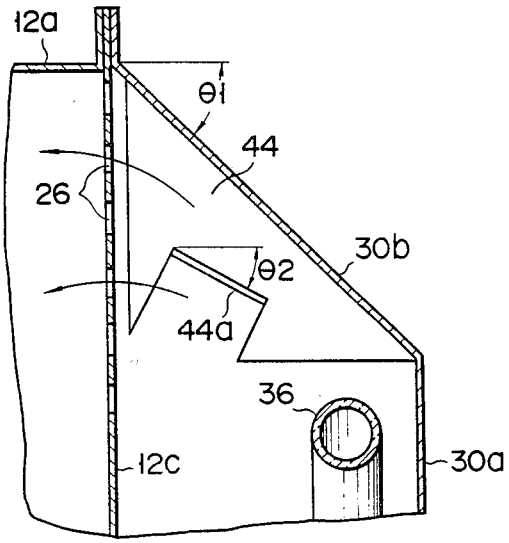

In the modification shown in FIGS. 9 and 10, airflow-directing mechanisms 40 and 42 have a plurality of airflow-directing plates 44 and 48 fixed to the inclined plates of cover 30, i.e., upper and lower plates 30*b* and 30*c* and extending in the vertical direction, respectively. Straightening plate 44*a* (48*a*) horizontally extends from each airflow-directing plate. Each plate 44*a* or 48*a* is formed by cutting part of the corresponding wind-directing plate and bending the cut portion upright, or fixing a separate plate on the corresponding airflow-directing plate by spot welding or the like. Assuming that the inclined angle of upper plate 30*b* with respect to the horizontal plane is $\theta 1$, plate 44*a* is inclined at angle $\theta 2$ (the same as or smaller than angle $\theta 1$) with respect to the horizontal plane. Plate 48*a* is also inclined at a predetermined angle with respect to the horizontal plane.

In the above modification, the air supplied from fan 34 is straightened by airflow-directing plates 44 and 48 and partially directed by straightening plates 44*a* and 48*a* in a direction different from that of the air directed by inclined plates 30*b* and 30*c* of cover 30. As a result, the hot air is sufficiently dispersed and uniformly discharged in heating chamber 14.

In FIGS. 5 to 10, the same portions as in the above embodiment are indicated by the same reference numerals and a detailed description thereof is omitted.

A plate for fixing the cover defining the storing chamber is not limited to the rear plate of the inner casing, but can be another side plate.

What is claimed is:

1. A hot air circulating cooker comprising:

a box-like casing having top and bottom plates, a pair of first side plates opposite one another, and a second side plate perpendicular to said first side plates and defining a heating chamber for storing food therein, each of said first side plates having first and second horizontal support rails which are separated from one another and are formed by projections of said first side plates into said heating chamber;

upper and lower cooking trays arranged in said heating chamber so as to be parallel to said top plate, said upper and lower trays each having a pair of side edges slidably mounted on the first and second support rails respectively and a rear edge abutting said second side plate so that said heating chamber is partitioned by said upper and lower trays into an upper space between said top plate and said upper tray, an intermediate space between said upper and lower trays and a lower space between said bottom plate and said lower tray;

said second side plate comprising:

a plurality of suction holes communicating with said intermediate space, a plurality of upper discharge holes formed in a horizontally extending area and communicating with said upper space, and a plurality of lower discharge holes formed in a horizontally extending area and communicating with said lower space;

a cover fixed to an outer surface of said second side plate for defining a storage chamber which communicates with said suction holes and said upper and lower discharge holes;

a fan arranged in said storage chamber so as to face said suction holes, said fan rotates in a predetermined rotation direction so as to draw air located in said intermediate space of said heating chamber into said storage chamber through said suction holes, causing an airflow in said predetermined rotation direction within said storage chamber, and discharging air to said upper and lower spaces through said upper and lower discharge holes respectively;

said cover including:

a bottom plate separated from and parallel to said second side plate, an upper plate opposing said upper discharge holes and extending in a horizontal direction, said upper plate being inclined so as to direct said airflow in said predetermined rotation direction toward said upper discharge holes, and a lower plate opposing said lower discharge holes and extending in a horizontal direction, said lower plate being inclined so as to direct said airflow in said predetermined rotation direction toward said lower discharge holes;

a heater arranged in said storage chamber and displaced along a periphery of said fan, said heater heating air drawn into said storage chamber;

drive means for rotating said fan;

upper airflow-directing means including an airflow directing plate arranged in said storage chamber outside said heater and fixed to said upper plate of said cover opposite said upper discharge holes, said upper airflow-directing means located to an upstream location so as to guide part of said airflow generated by said fan through said upper discharge holes located at an upstream side; and lower airflow-directing means including an airflow-directing plate arranged in said storage chamber outside said heater and fixed to said lower plate of said cover opposite said lower discharge holes said lower airflow-directing means located at an upstream location so as to guide part of said airflow generated by said fan through said lower discharge holes located at an upstream side.

2. A cooker according to claim 1, wherein said airflow-directing plates of the upper and lower airflow-directing means are arranged to be point-symmetrical to each other with respect to a rotational center of the fan.

3. A cooker according to claim 1, wherein each of said airflow-directing plates extends in the vertical direction.

4. A cooker according to claim 1, wherein said upper airflow-directing means includes a second airflow-directing plate which is fixed to the bottom plate of the cover, located between the fan and the heater, and provided contiguously with the airflow-directing plate, and said lower airflow-directing means includes second airflow-directing plate which is fixed to the bottom plate of the cover, located between the fan and the heater, and provided contiguously with the airflow-directing plate.

5. A cooker according to claim 4, wherein each of said second airflow-directing plates extends from the region close to the corresponding airflow-directing plate toward the rotational center of the fan.

6. A cooker according to claim 4, wherein a diameter of said fan is set in a range of about $\frac{1}{2}$ to $\frac{1}{3}$ the width in the horizontal direction of the heating chamber.

7. A cooker according to claim 4, wherein a distance between said second airflow-directing plates and the periphery of the fan is set in a range of about 1/10 to 1/20 a diameter of the fan.

8. A cooker according to claim 4, wherein said upper airflow-directing means includes a third airflow-directing plate provided parallel to the second airflow-directing plate on the downstream side of the air flow in the storing chamber with respect to the second airflow-directing plate, said lower airflow-directing means includes a third airflow-directing plate provided parallel to the second airflow-directing plate on the downstream side of the air flow in the storing chamber with respect to the second airflow-directing plate, and distances between the second and third airflow-directing plates are set in a range of about $\frac{1}{3}$ to 1/6 the diameter of the fan.

9. A cooker according to claim 8, wherein distance between each of said third airflow-directing plates and the periphery of the fan is set in a range of about 1/5 to 1/10 the diameter of the fan.

10. A cooker according to claim 8, wherein distance between each of said second and third airflow-directing plates and the periphery of the heater is set in a range of about $\frac{1}{2}$ to 1/10 a diameter of the heater.

11. A cooker according to claim 1, wherein:

said upper airflow-directing means has a plurality of airflow-directing plates fixed to the upper plate, the airflow-directing plates being separated from each other at equal intervals along the horizontal direction and extending in the vertical direction; and said lower airflow-directing means has a plurality of airflow-directing plates fixed to the lower plate, the airflow-directing plates being separated from each other at equal intervals along the horizontal direction and extending in the vertical direction.

12. A cooker according to claim 9, wherein lengths of said airflow-directing plates of the upper and lower airflow-directing means in the vertical direction are gradually decreased from one located at the upstream side of the air flow in the storing chamber to one located at the downstream side thereof.

13. A cooker according to claim 1, wherein each of said airflow-directing plates of the upper and lower airflow-directing means has a straightening plate extending in the horizontal direction from the airflow-directing plate, the straightening plate being inclined at an angle not more than an inclined angle of the upper or lower plate with respect to a horizontal plane.

* * * * *